US009850684B2

(12) United States Patent
Dore Vasudevan et al.

(10) Patent No.: US 9,850,684 B2
(45) Date of Patent: Dec. 26, 2017

(54) SENSOR ASSEMBLIES FOR LOCKS

(71) Applicant: Schlage Lock Company LLC, Indianapolis, IN (US)

(72) Inventors: Sundar Raj Dore Vasudevan, Bangalore (IN); Dilip Bangaru, Bangalore (IN); Adam Michael Litwinski, Centennial, CO (US); Allen Madrid, Peyton, CO (US)

(73) Assignee: Schlage Lock Company LLC, Carmel, IN (US)

( * ) Notice: Subject to any disclaimer, the term of this patent is extended or adjusted under 35 U.S.C. 154(b) by 579 days.

(21) Appl. No.: 14/334,515

(22) Filed: Jul. 17, 2014

(65) Prior Publication Data

US 2016/0017638 A1 Jan. 21, 2016

(51) Int. Cl.

| | |
|---|---|
| ***E05C 1/02*** | (2006.01) |
| ***E05B 17/22*** | (2006.01) |
| ***E05B 47/06*** | (2006.01) |
| ***E05B 55/12*** | (2006.01) |
| ***E05B 63/16*** | (2006.01) |
| *E05C 1/00* | (2006.01) |
| *E05B 63/08* | (2006.01) |
| *E05B 63/00* | (2006.01) |
| *E05B 47/00* | (2006.01) |

(52) U.S. Cl.

CPC ..... *E05B 17/22* (2013.01); *E05B 47/0673* (2013.01); *E05B 55/12* (2013.01); *E05B 63/16* (2013.01); *E05B 63/0056* (2013.01); *E05B 63/08* (2013.01); *E05B 2047/0067* (2013.01); *Y10T 292/1097* (2015.04)

(58) Field of Classification Search

CPC .... E05B 63/0056; E05B 63/08; E05B 63/044; E05B 63/04; E05B 2047/0067; Y10T 292/1097

USPC ..... 70/107–111, 278.7, 432, 462, 279.1

See application file for complete search history.

(56) References Cited

U.S. PATENT DOCUMENTS 3,750,433 A * 8/1973 Sanders ..... E05B 63/16 292/165
3,999,411 A * 12/1976 Kambic ..... E05B 55/00 292/165

(Continued)

FOREIGN PATENT DOCUMENTS

AU WO 2006039751 A1 * 4/2006 ..... E05B 13/004
DE 102006060448 A1 6/2008

(Continued)

OTHER PUBLICATIONS

International Search Report; International Searching Authority; International PCT Application No. PCT/US2015/040895; dated Oct. 8, 2015; 2 pages.

(Continued)

*Primary Examiner* — Carlos Lugo

(74) *Attorney, Agent, or Firm* — Taft Stettinius & Hollister LLP

(57) ABSTRACT

A locking assembly including first and second hubs rotatably mounted in a case, a latch assembly which retracts in response to rotation of either of the hubs, and a locking member which selectively prevents rotation of at least one of the hubs. A sensor assembly is associated with at least one of the hubs, and is configured to transmit a signal in response to rotation of the at least one hub.

21 Claims, 10 Drawing Sheets

(56) References Cited

U.S. PATENT DOCUMENTS 4,298,223 A 11/1981 Raffelsiefer et al.
4,695,082 A * 9/1987 Marks ..... E05B 63/044 292/169.16
5,678,870 A * 10/1997 Pelletier ..... E05B 55/12 292/169.16
5,757,269 A * 5/1998 Roth ..... E05B 45/083 200/61.68
5,783,995 A 7/1998 Jackson
5,825,288 A * 10/1998 Wojdan ..... E05B 45/083 292/340
6,578,888 B1 6/2003 Fayngersh et al.
6,622,535 B2 * 9/2003 Chiang ..... E05B 47/0692 292/DIG. 27
6,732,557 B1 * 5/2004 Zehrung ..... E05B 47/0002 248/671
6,784,784 B1 8/2004 Zehrung
6,953,210 B2 * 10/2005 Lemettinen ..... E05B 9/02 292/144
7,303,215 B2 * 12/2007 Moon ..... E05B 47/0673 292/169
7,614,669 B2 * 11/2009 Geringer ..... E05B 47/0657 292/144
7,866,713 B2 * 1/2011 Chen ..... E05B 13/004 292/165
7,990,280 B2 8/2011 Gray
8,058,575 B1 11/2011 Zehrung
8,201,858 B1 * 6/2012 Moon ..... E05B 13/004 292/164
8,325,039 B2 12/2012 Picard et al.
8,419,086 B2 * 4/2013 Moon ..... E05B 17/2026 292/108
8,451,087 B2 5/2013 Krishnan et al.
8,540,290 B2 * 9/2013 Chen ..... E05B 47/0673 292/144
9,262,875 B1 * 2/2016 Chen ..... G07C 9/00007
9,334,676 B2 * 5/2016 Lambrou
2006/0087125 A1 4/2006 Moon et al.
2007/0075852 A1 4/2007 Schmidt et al.
2007/0114800 A1 * 5/2007 Kuo ..... E05B 13/004 292/244
2010/0192650 A1 8/2010 Fowler et al.
2010/0289275 A1 * 11/2010 Marks ..... E05B 63/0065 292/245
2011/0090077 A1 4/2011 Meyer et al.
2011/0203331 A1 * 8/2011 Picard ..... E05B 9/02 70/91
2012/0073482 A1 3/2012 Meeker et al.
2012/0186312 A1 7/2012 Lowder et al.
2012/0198896 A1 8/2012 Moon
2014/0026627 A1 1/2014 Rai et al.
2016/0043516 A1 * 2/2016 Lowder ..... H01R 13/465 439/133
2016/0145904 A1 * 5/2016 Lowder ..... E05B 63/08 340/542
2016/0153213 A1 * 6/2016 Huang ..... E05B 63/08 292/144
2017/0044800 A9 * 2/2017 Lowder ..... E05B 63/08

FOREIGN PATENT DOCUMENTS

DE EP 2520746 A1 * 11/2012 ..... E05B 47/0012
EP 2290180 * 3/2011
JP 05214864 A * 8/1993 ..... E05B 63/0056
WO WO 9601355 * 1/1996
WO WO 2014/028332 2/2014

OTHER PUBLICATIONS

Written Opinion; International Searching Authority; International PCT Application No. PCT/US2015/040895; dated Oct. 8, 2015; 11 pages.

* cited by examiner

SENSOR ASSEMBLIES FOR LOCKS

TECHNICAL FIELD

The present invention generally relates to sensor assemblies, and more particularly, but not exclusively, to sensor assemblies which detect at least one condition of a lock assembly.

BACKGROUND

Lock assemblies are commonly installed on doors to control access to a secured region or environment, and often include handles on opposing sides of the door which can be actuated to retract a latch bolt. In certain settings, it is desirable to record data regarding the operation of the lock assembly. Some lock systems have certain limitations, such as those relating to independently or selectively monitoring operation of the handles. Additionally, constraints regarding the space available within a lock assembly may impede efforts to monitor other conditions within the lock assembly. Therefore, a need remains for further improvements in systems and methods for monitoring conditions of a lock assembly.

SUMMARY

One form of a locking assembly includes first and second hubs rotatably mounted in a case, a latch assembly which retracts in response to rotation of either of the hubs, and a locking member which selectively prevents rotation of at least one of the hubs. A sensor assembly is associated with at least one of the hubs and is configured to transmit a signal in response to rotation of the at least one hub. Further embodiments, forms, features, aspects, benefits, and advantages of the present invention shall become apparent from the description and figures provided herewith.

DETAILED DESCRIPTION OF ILLUSTRATIVE EMBODIMENTS

Figure 1:
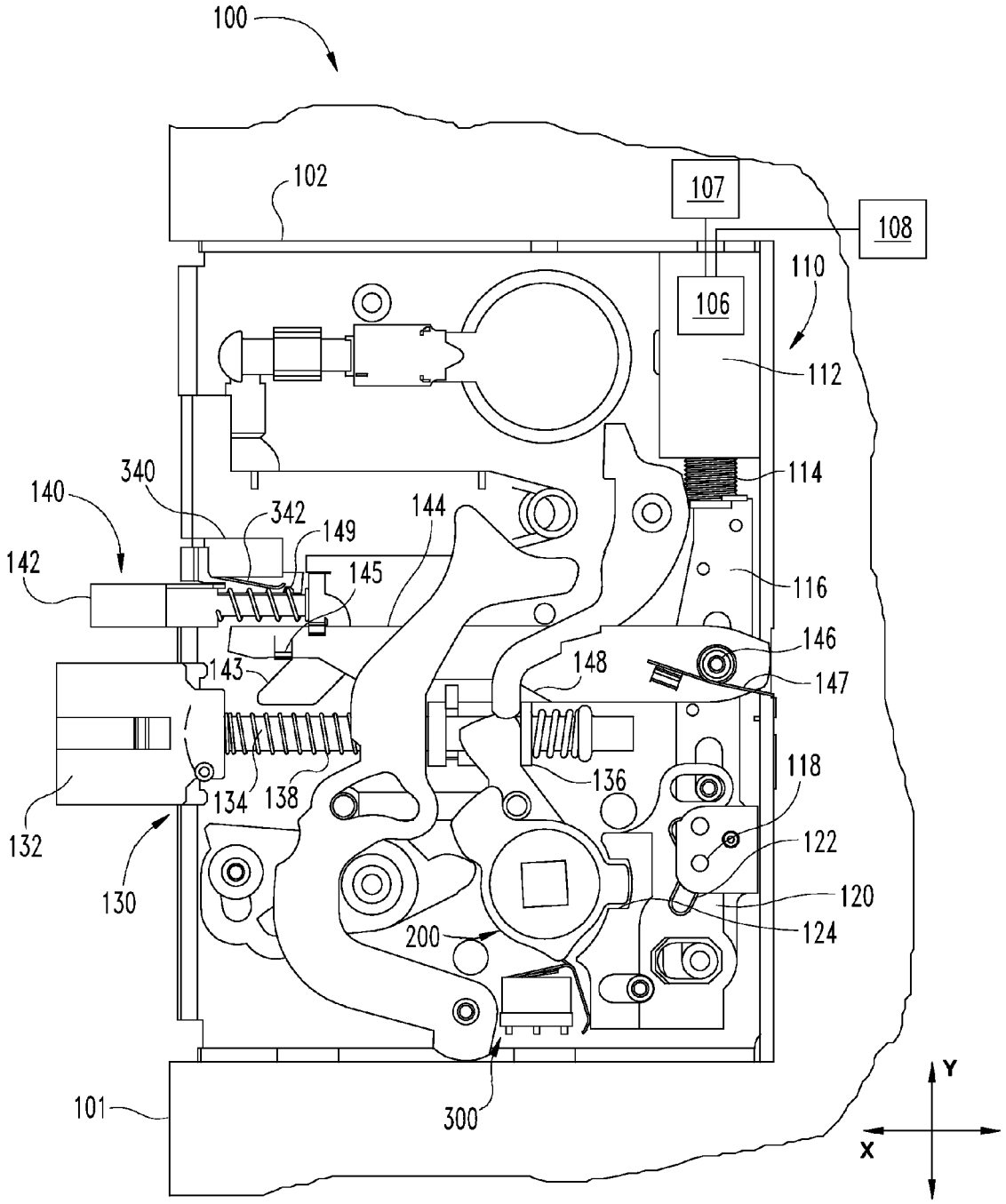
FIG. 1 is an elevational view of a lock assembly according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, shown therein is one form of a mortise lock assembly 100 configured for mounting in a door 101. The mortise lock assembly 100 includes a case 102 that houses a drive assembly 110, a locking member or catch 120 driven by the drive assembly 110, a latch assembly 130 including a retractable latch bolt 132, a deadlocking assembly 140 operable to deadlock the latch bolt 132 when the door 101 is closed, a transmission assembly 200 connected to the latch assembly 130 and operable to retract the latch bolt 132, and a sensor assembly 300 configured to detect various states of the lock assembly 100. The lock assembly 100 further includes a cover plate (not illustrated) which retains components of the lock assembly 100 within the case 102.

The mortise lock assembly 100 may be installed in a door 101 having a secured or inner side and an unsecured or outer side. Additionally, a pair of manual actuators such as handles, knobs, or levers (not illustrated) may be coupled to the transmission assembly 200. For example, an inner handle may be coupled to the transmission 200 on the secured side of the door 101, and an outer handle may be coupled to the transmission 200 on the unsecured side of the door 101. As described in further detail below, the drive assembly 110 moves the catch 120 between a locking position and an unlocking position to define locked and unlocked states of the lock assembly 100. With the catch 120 in the unlocking position, the outer handle is free to rotate, and rotation of the outer handle is transmitted through the transmission 200 to cause retraction of the latch assembly 130. When in the locking position, the catch 120 engages the transmission 200 such that rotation of the outer handle is prevented, and the outer handle is not operable to retract the latch assembly 130.

The lock assembly 100 also includes a controller 106 which controls operation of the drive assembly 110 to move the catch 120 between the locking and unlocking positions. The controller 106 may be in communication with a user interface 107 such as a keypad or credential reader which may be mounted on or adjacent to the door 101. The controller 106 may additionally or alternatively be in communication with a control system 108. In operation, the controller 106 may maintain the lock assembly 100 in the locked state, and may operate the drive assembly to move the catch 120 to the unlocked position in response to an authorized unlock command from the user interface 107 and/or the control system 108.

The description set forth herein relating to the controller 106, the user interface 107, and the control system 108 emphasizes the structural independence of these features, and illustrates one exemplary grouping of operations and responsibilities. Other groupings that execute similar overall operations are to be understood as falling within the scope of the present invention. That is to say, while the user interface 107 is described above as issuing an authorized unlock command to the controller 106, the user interface 107 may merely transmit data relating to a user credential to the controller 106, and the controller 106 may determine whether the credential is authorized and in turn operate the drive assembly 110 in response thereto.=

The controller 106 and/or the control system 108 may also store data relating to the time and date of the unlock command, the location or identity of the lock assembly 100, and/or the identity of the user issuing the unlock command. For example, if the user interface 107 comprises a keypad, the user interface 107 may transmit data relating to an entered code to the controller 106. The controller 106 may then determine whether the entered code is an authorized code, log the result, and operate the drive assembly 110 in response to the entered code being an authorized code.

In certain forms, the controller 106 may be in further communication with the sensor assembly 300. In such embodiments, the controller 106 may store data relating to signals received from the sensor assembly, and may communicate such data to the user interface 107 and/or the control system 108 in response to an authorized request. In other embodiments, the sensor assembly 300 may be in direct or indirect communication with the user interface 107 and/or the control system 108, and communication of the data may bypass the controller 106. Further details regarding the sensor assembly 300 and the data signals transmitted thereby are set forth below.

In the illustrated embodiment, the drive assembly 110 includes an electromechanical actuator such as a solenoid 112 which is operable to extend or retract a plunger 114. A link 116 is coupled to the plunger 114 such that the link 116 extends and retracts in response to actuation of the solenoid. While the illustrated electromechanical actuator is configured as a solenoid 112, other forms of actuator are contemplated as within the scope of the invention. For example, in certain forms, the solenoid 112 and plunger 114 may be replaced by a rotary motor and helical drive member such as a spring. An exemplary form of such an assembly is described in commonly-owned U.S. patent application Ser. No. 14/194,605 filed Feb. 28, 2014, the contents of which are incorporated by reference in their entirety.

The exemplary locking member or catch 120 is coupled to the link 116 such that longitudinal motion (i.e., motion along the illustrated Y-axis) of the link 116 causes lateral motion (i.e., motion along the illustrated X-axis) of the catch 120 between a locking position and an unlocking position. For example, the link 116 may include a rivet or pin 118 which extends into an angled cam slot 122 formed in the catch 120 such that the pin 118 urges the catch 120 in the lateral direction in response to longitudinal motion of the link 116. It is also contemplated that the catch 120 may be moved in the lateral direction in another manner. For example, the solenoid 112 may be aligned with the catch 120 such that plunger 114 travels in the lateral direction. The catch 120 may also include a recess 124, the function of which will be described below.

In the illustrated embodiment, the latch assembly 130 includes a latch bolt 132, a driver bar 134 operable to retract the latch bolt 132, a saddle 136 slidingly mounted to the driver bar 134, a first biasing member such as a latch bolt spring 138 which urges the latch bolt 132 toward an extended position, and a second biasing member such as a saddle spring 139 which urges the saddle 136 toward the latch bolt 132. As described in further detail below, the saddle 136 is engageable with the transmission assembly 200 such that actuation of the transmission assembly 200 moves the saddle 136 in a direction toward the link 116.

In the illustrated embodiment, the lock assembly 100 also includes a deadlocking assembly 140 which may be of the type described in the commonly-owned U.S. Pat. No. 4,583,382 to Hull. The deadlocking assembly 140 includes an auxiliary bolt 142 slidingly mounted to the case 102, a deadlocking member 144 pivotably mounted on a post 146, and a biasing member such as a torsion spring 147 rotationally biasing the deadlocking member 144 toward the transmission assembly 200. The rear portion of the auxiliary bolt 142 includes a ramp 143 which is engaged with a tab 145 formed on the deadlocking member 144. When the door 101 is closed, the auxiliary bolt 142 is depressed to a retracted position via contact with the door frame. As the auxiliary bolt 142 retracts, the spring 147 urges the deadlocking member 144 to a blocking position, wherein the free end of the deadlocking member 144 is aligned with the latch bolt 132. In this position, the deadlocking member 144 prevents the latch bolt 132 from being forced inwardly by an externally-applied force, thereby deadlocking the latch bolt 132.

When one of the handles is actuated, the transmission assembly 200 drives the saddle 136 toward the link 116. The slideable mounting of the saddle 136 on the driver bar 134 forms a lost motion connection between these elements. During the lost motion portion of its travel, the saddle 136 engages a ramp 148 on the deadlocking member 144, thereby pivoting the deadlocking member 144 to an unblocking position. In the unblocking position, the free end of the deadlocking member 144 is not aligned with the latch bolt 132 such that the latch bolt 132 may be retracted. As the transmission assembly 200 drives the saddle 136 beyond the region of lost motion, the driver bar 134 begins to move with the saddle 136, thereby causing retraction of the latch bolt 132. When the door 101 is subsequently opened, the auxiliary bolt 142 moves to an extended position under the force of a biasing spring 149, and the deadlocking member 144 is retained in the unblocking position via engagement between the ramp 143 and the tab 145.

Figure 2:
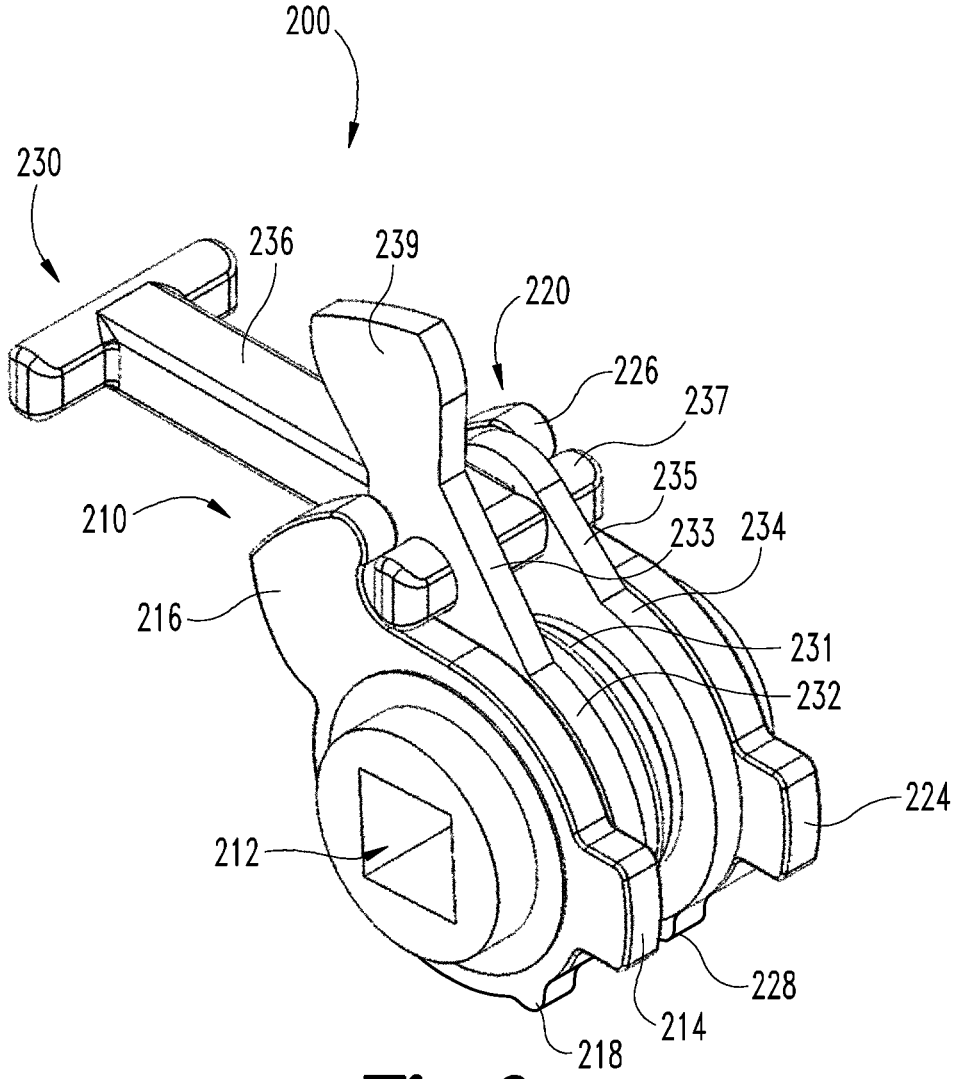
FIG. 2 is an isometric illustration of a transmission assembly usable with the lock assembly depicted in FIG. 1.

With reference to FIG. 2, the transmission assembly 200 is operable to retract the latch bolt 132 in response to actuation of one of the handles (not illustrated). The transmission assembly 200 includes a top hub 210, a bottom hub 220, and a retractor assembly 230 positioned between the hubs 210, 220. Unless noted otherwise, the terms "top" and "bottom" are used herein to refer to the relative positions of an element within the case 102. Thus, the bottom hub 220 is positioned adjacent the rear plate of the case 102, and the top hub 210 is positioned adjacent the cover plate, or "above" the bottom hub 220. When the illustrated lock assembly 100 is assembled with the inner and outer handles, the top hub 210 is connected to the inner handle and the bottom hub 220 is connected to the outer handle. As described in further detail below, it is also contemplated that these orientations may be reversed such that the top hub 210 is connected to the outer handle and the bottom hub 220 is connected to the inner handle.

In the illustrated embodiment, the top hub 210 includes an opening 212 structured to receive a spindle of the inner handle such that the top hub 210 is rotationally coupled to the inner handle. The top hub 210 also includes a protrusion 214 having a size and shape corresponding to the catch recess 124, a radial arm 216 engageable with the retractor assembly 230, and a cam surface 218 engageable with the sensor assembly 300. In the illustrated form, the cam surface 218 is configured as a radial protrusion or bump, although it is also contemplated that the cam surface 218 may be configured as a radial recess or valley. The bottom hub 220 is configured for connection with a spindle of an outer handle such that the bottom hub 220 is rotationally coupled to the outer handle. The bottom hub is substantially similar to the top hub 210, and similar reference characters are used to indicate similar features.

The retractor assembly 230 includes a bearing 231, top and bottom drive discs 232, 234 mounted on the bearing 231, and a retractor bar 236 including a cross-bar 237. Each of the drive discs 232, 234 includes an arm 233, 235, respectively, each of which defines an opening sized and configured to receive the cross-bar 237. At least one of the arms 233, 235 includes an extension 239 operable to engage the saddle 136 when the corresponding drive disc 232, 234 is rotated. The cross-bar 237 extends through the openings in the drive disc arms 233, 235 such that the cross-bar 237 is positioned adjacent the hub arms 216, 226. Thus, when either of the hubs 210, 220 is rotated (e.g., in response to actuation of the corresponding handle), the corresponding hub arm 216, 226 engages the cross-bar 237 and rotates the drive discs 232, 234. Rotation of the drive discs 232, 234 causes the extension 239 to engage the saddle 136, thereby retracting the driver bar 134 and the latch bolt 132. Additionally, the top and bottom hubs 210, 220 may be rotationally decoupled from one another such that each of the handles is independently operable to retract the latch bolt 132 by rotating the corresponding hub 210, 220.

Figure 3:
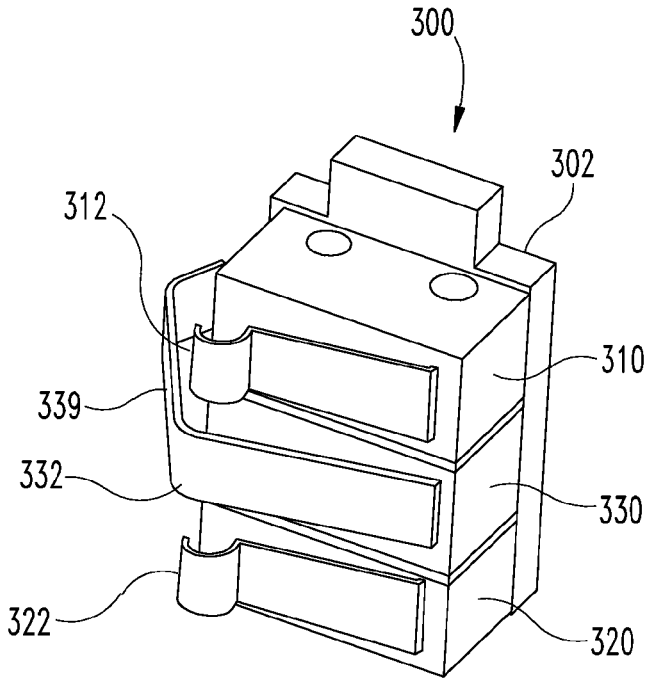
FIG. 3 is a perspective illustration of a sensor assembly according to one embodiment.
Figure 4:
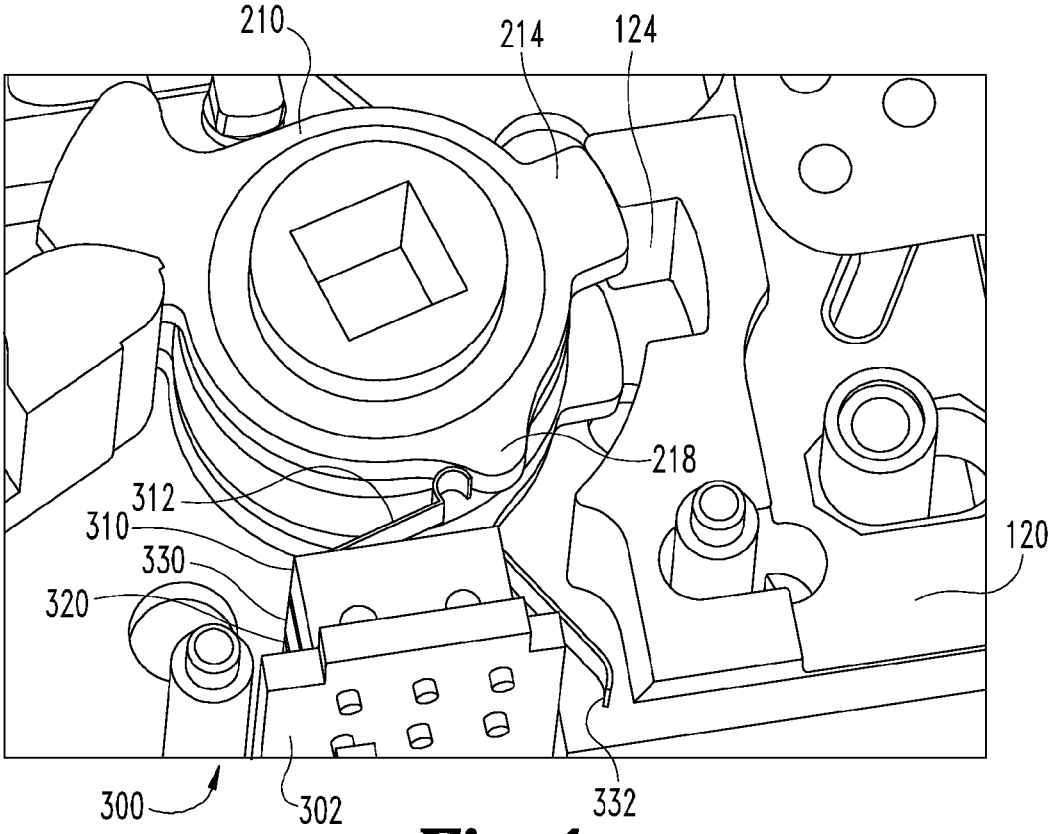
FIG. 4 depicts the transmission assembly of FIG. 2 and the sensor assembly of FIG. 3.

With reference to FIG. 3, the sensor assembly 300 includes a top sensor 310, a bottom sensor 320, and a lock sensor 330, and may further include an auxiliary bolt sensor 340 (FIG. 1). The sensor assembly 300 further includes a printed circuit board (PCB) 302, with three sensors 310, 320, 330 mounted to the PCB 302. As described in further detail below, each of the sensors 310, 320, 330, 340 is associated with a different element of the lock assembly 100, and each is operable to detect a different condition of the lock assembly 100 and to transmit a signal indicative of the detected condition. As noted above, in the illustrated form, the sensor assembly 300 is in communication with the controller 106 which logs the signals to provide an audit trail regarding operation of the lock assembly 100. It is also contemplated that the sensor assembly 300 may be in direct or indirect communication with the user interface 107, the control system 108, and/or other elements of an access control system.

In certain embodiments, each of the sensors 310, 320, 330, 340 comprises single pole, double throw (SPDT) electric switch. It is also contemplated that other forms of sensors such as, for example, optical sensors, proximity sensors, Hall effect sensors, and/or Reed switches, may be utilized. Furthermore, while each of the illustrated switches is configured as a snap-action switch or microswitch, it is also contemplated that other forms of electric switches such as, for example, rocker switches, slider switches, or toggle switches, may be utilized.

As is known in the art, microswitches commonly include an input terminal, an output terminal, and an actuator such as a button operable to selectively complete an electrical connection between the input terminal and the output terminal. An input signal may be provided to the input terminal such that when the electrical connection is completed or closed, the signal is transmitted from the input terminal to the output terminal. This closing of the connection may be considered actuation of the microswitch, and the signal being transmitted from the output terminal may be considered a signal which has been issued or transmitted by the microswitch in response to the actuation.

As is also known in the art, microswitches may have a default state and a non-default state, and often include a resilient trigger arm such as a leaf spring. When an external force is applied to the leaf spring, the leaf spring depresses the button, and the microswitch transitions from the default state to the non-default state. When the external force is removed, the leaf spring and the button return to their biased positions, and the microswitch returns to the default state. In a normally closed microswitch, the default state is closed, and depressing the leaf spring opens or breaks an electrical connection. In a normally open microswitch, the default state is open, and depressing the leaf spring closes or completes an electrical connection. SPDT switches may include an input terminal, a normally open output terminal, and a normally closed output terminal. Thus, the default state of an SPDT microswitch can be easily changed by connecting the control circuit to the appropriate terminal. Alternatively, SPDT switches can be connected to the control circuit through each of the output terminals. In such forms, the SPDT switch may act as a dual-action switch which continuously transmits the signal through the output terminal corresponding to the position of the leaf spring.

The top sensor 310 is associated with the top hub 210 and may be configured to transmit a first signal in response to rotation of the top hub 210 from the home position to a rotated position. The top sensor 310 also includes a leaf spring 312 in contact with the outer surface of the top hub 210. While other forms are contemplated, the illustrated sensor 310 is a simulated roller switch which is normally closed. That is to say, the default state of the sensor 310 is closed, and depressing the leaf spring 312 breaks the electrical connection such that the first signal is not transmitted. As described below, the sensor 310 may alternatively be configured as a dual-action switch which transmits the first signal via the normally open terminal when the leaf spring 312 is depressed.

Figure 5:
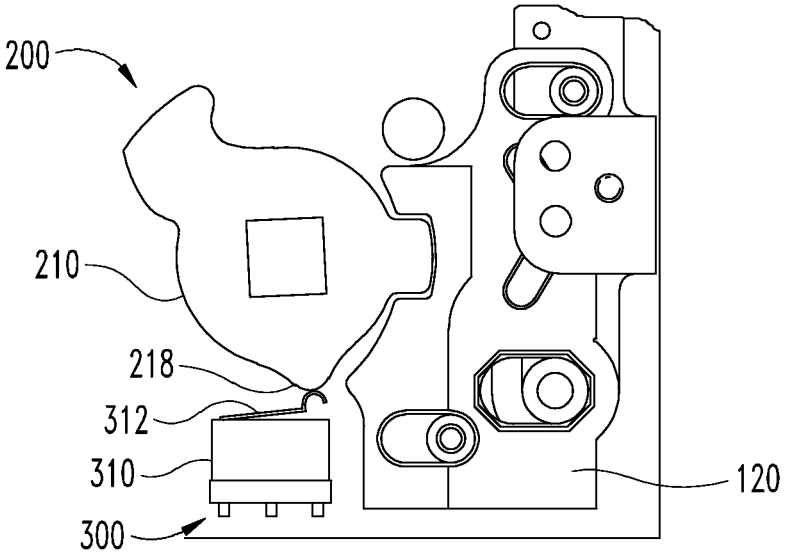
FIG. 5 depicts a portion of the lock assembly of FIG. 1 in a home position.
Figure 6:
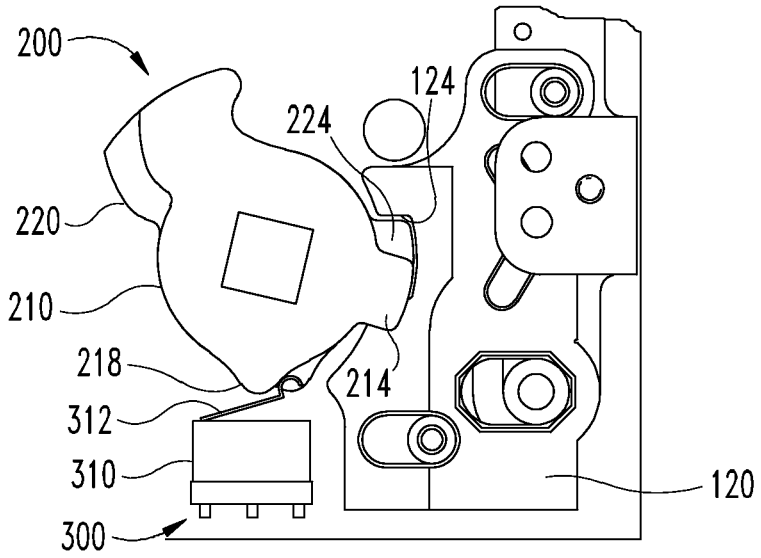
FIG. 6 depicts a portion of the lock assembly of FIG. 1 in a rotated position.

With reference to FIGS. 5 and 6, when the top hub 210 is in the home position (FIG. 5) the cam surface 218 engages the leaf spring 312, thereby retaining the leaf spring 312 in the depressed position. When the top hub 210 is rotated from the home position by a predetermined angle to a rotated position (FIG. 6), the cam surface 218 no longer engages the leaf spring 312. The leaf spring 312 is thus released and moves to the extended position. In embodiments in which the sensor 310 is configured as a normally closed switch, the sensor 310 transitions to the closed state and transmits the first signal in response to the extended position of the leaf spring 312. Because the top hub 210 is coupled to the inner handle, rotation of the top hub 210 indicates that a user is attempting to retract the latch bolt 132 from the secured side of the room. The controller 106 may in turn interpret the signal from the top sensor 310 as a request to exit.

As should be appreciated, the predetermined angle through which the top hub 210 must rotate in order to cause the sensor 310 to transition states depends on a number of factors such as, for example, the size, shape, orientation, and configuration of the cam surface 218 and the leaf spring 312. In the illustrated form, the cam surface 218 and the leaf spring 312 are configured to cause the sensor 310 to transition states when the inner hub 210 is rotated by about 10° in either direction. It is also contemplated that other predetermined angles may be utilized, and those skilled in the art would be able to select configurations of the cam surface 218 and the sensor 310 to cause the sensor 310 to transition states in response to a variety of rotational angles of the hub 210.

In the illustrated embodiment, the top sensor 310 comprises a normally closed switch, and the cam surface 218 depresses the leaf spring 312 to break the electrical connection. It is also contemplated that the sensor 310 may comprise a normally open switch such that the sensor 310 transmits the first signal when the top hub 210 is in the home position. In such a case, the sensor 310 may cease transmitting the first signal when the hub 210 is rotated, and the controller 106 may interpret cessation of the first signal as a request to exit. In another form, the cam surface 218 may comprise a recess instead of a protrusion such that the sensor 310 is in the open state when the hub 210 is in the home position, and transitions to the closed state in response to rotation of the hub 210. In embodiments in which the sensor 310 includes multiple output terminals (e.g., an SPDT switch including normally open and normally closed output terminals), the sensor 310 may transmit the signal via a first terminal when the leaf spring 312 is in the depressed position, and may transmit the signal via a second terminal when the leaf spring 312 is in the extended position such as, for example, as described below with reference to FIG. 9.

The bottom sensor 320 is associated with the bottom hub 220 and may be configured to transmit a second signal in response to rotation of the bottom hub 220 from the home position. The bottom sensor 320 includes a leaf spring 322 in contact with the outer surface of the bottom hub 220. Like the top sensor 310, the bottom sensor 320 may be a normally closed simulated roller switch, and may transmit the second signal in response to rotation of the bottom hub 220 in a manner substantially similar to that described above with respect to the top sensor 310. Because the bottom hub 220 is coupled to the outer handle, rotation of the bottom hub 220 indicates that a user is attempting to retract the latch bolt 132 from the unsecured side of the room. As such, the controller 106 may interpret the signal from the bottom sensor 320 as a request to enter. Additionally, the controller 106 may associate the data relating to the request to enter with the data relating to the identity of the user that transmitted the unlock command such that the audit trail includes information relating to the particular user that initiated the request to enter.

Figure 7:
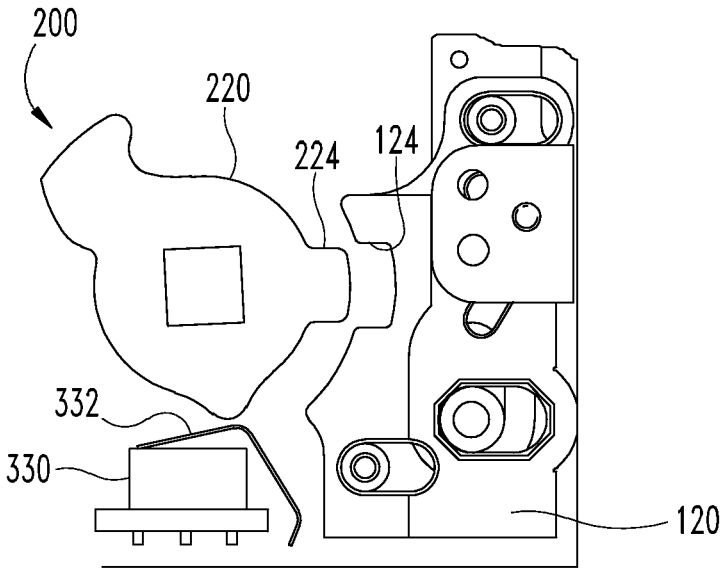
FIG. 7 depicts a portion of the lock assembly of FIG. 1 in an unlocked state.
Figure 8:
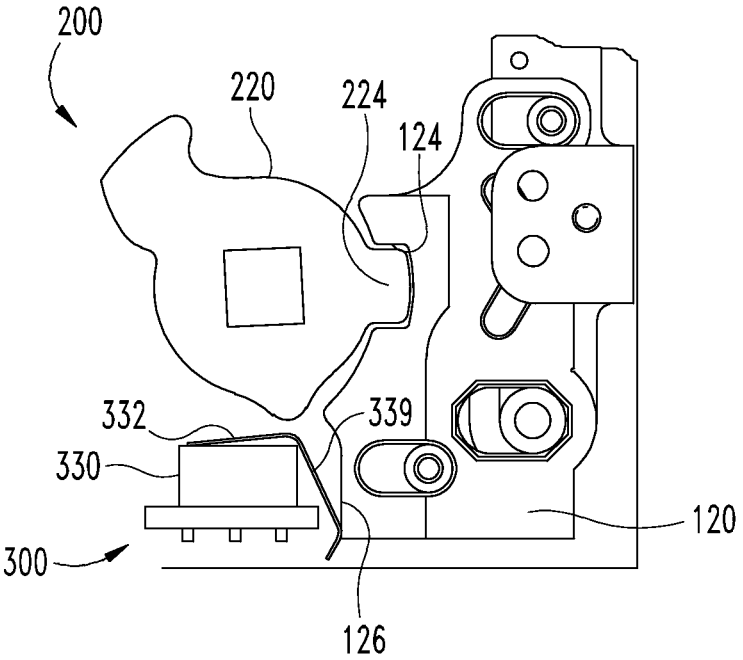
FIG. 8 depicts a portion of the lock assembly of FIG. 1 in a locked state.

With reference to FIGS. 7 and 8, the lock sensor 330 is associated with the catch 120 and may be configured to transmit a third signal in response to the locking position of the catch 120. The illustrated lock sensor 330 is a microswitch comprising a leaf spring 332 including an actuating segment which extends across the front surface of the sensor 320, and an angled engaging segment 339 which extends toward the catch 120 and the PCB 302. While other forms are contemplated, the illustrated lock sensor 330 is a normally open switch which transmits a signal when the leaf spring 332 is depressed.

When in the unlocking position (FIG. 7), the catch 120 does not engage the leaf spring 332, and the sensor 330 remains in the open state. Additionally, the bottom hub protrusion 224 is not received in the catch recess 124, and the bottom hub 220 is free to rotate. As the catch 120 moves to the locking position (FIG. 8), an edge 126 of the catch 120 contacts the engaging segment 339, thereby pivoting the actuating segment of the leaf spring 332 to the depressed position. The lock sensor 330 is thus in the closed state, and transmits the third signal in response thereto. With the catch 120 in the locking position, the bottom hub protrusion 224 is received in the catch recess 124, and the bottom hub 220 is thus locked against rotation, thereby defining a locked state of the lock assembly 100. The controller 106 may in turn interpret the signal from the lock sensor 330 as indicating a locked condition of the lock assembly 100.

In the illustrated form, engagement between the catch 120 and the bottom hub 220 is effected by the recess 124 formed on the catch 120 and the protrusion 224 formed on the bottom hub 220. It is also contemplated that the catch 120 may comprise a protrusion, the hub 220 may comprise a correspondingly-shaped recess, and the catch protrusion may be received in the hub recess when the catch 120 is in the locking position.

Referring once again to FIGS. 5 and 6, the catch 120 is illustrated in the locking position wherein the bottom hub protrusion 224 is received in the catch recess 124. In the illustrated form, the catch 120 is not aligned with the top hub 210 such that with the catch 120 in the locking position, the top hub protrusion 214 is not received in the catch recess 124. The top hub 210 remains free to rotate, and the latch bolt 132 can be retracted by the inner handle even when the lock assembly 100 is in the locked state. In other embodiments, the catch 120 may be aligned with both of the hubs 210, 220 such that each of the hubs 210, 220 is locked against rotation when the lock assembly 100 is in the locked state.

In other embodiments, the top hub 210 may be coupled to the outer handle, and the bottom hub 220 may be coupled to the inner handle. In such forms, the catch 120 may be aligned with the top hub 210 such that the catch 120 prevents rotation of the top hub 210 when in the locking position. The bottom hub 220 may remain free to rotate such that the inner handle connected thereto remains operable to retract the latch bolt 132.

In still further embodiments, the lock assembly 100 may include an adjustment mechanism (not illustrated) operable to move the catch 120 transversely (i.e., in a direction perpendicular to the illustrated plane). In such embodiments, the adjustment mechanism may be operable to adjust the transverse position of the catch 120 between an upper position wherein the catch 120 is aligned with only the top hub 210, a lower position wherein the catch 120 is aligned with only the bottom hub 220, and an intermediate position wherein the catch 120 is aligned with each of the hubs 210, 220. Such an adjustment feature enables the lock assembly 100 to operate in a number of different configurations depending on which hub 210, 220 is connected to the inner handle.

The auxiliary bolt sensor 340 is associated with the deadlocking assembly 140 and may be configured to transmit a fourth signal in response to the retracted state of the auxiliary bolt 142. The exemplary auxiliary bolt sensor 340 is a normally open simulated roller switch, although other forms are contemplated. In the illustrated form, the auxiliary bolt sensor 340 is positioned adjacent the auxiliary bolt 142 such that the leaf spring 342 extends into the path of travel of the auxiliary bolt 142. As such, when the auxiliary bolt 142 moves to the retracted position, it depresses the leaf spring 342, thereby transitioning the auxiliary bolt sensor 340 to the closed state at which point the electrical connection is completed and the fourth signal is transmitted. Due to the fact that the auxiliary bolt 142 is urged to the retracted position when the door 101 is closed, the controller 106 may interpret the signal from the auxiliary bolt sensor 340 as indicating a door closed condition.

While the illustrated auxiliary bolt 142 comprises a portion of the deadlocking assembly 140, other forms are contemplated. In certain embodiments, the deadlocking member 144 may be omitted, and the auxiliary bolt 142 may be utilized merely as an indicator that the door 101 is closed. In further embodiments, the auxiliary bolt sensor 340 need not necessarily be associated with the deadlocking assembly 140. For example, the auxiliary bolt sensor 340 may instead be associated with a secondary auxiliary bolt (not illustrated) which retracts when the door 101 is in the closed position.

Figure 9:
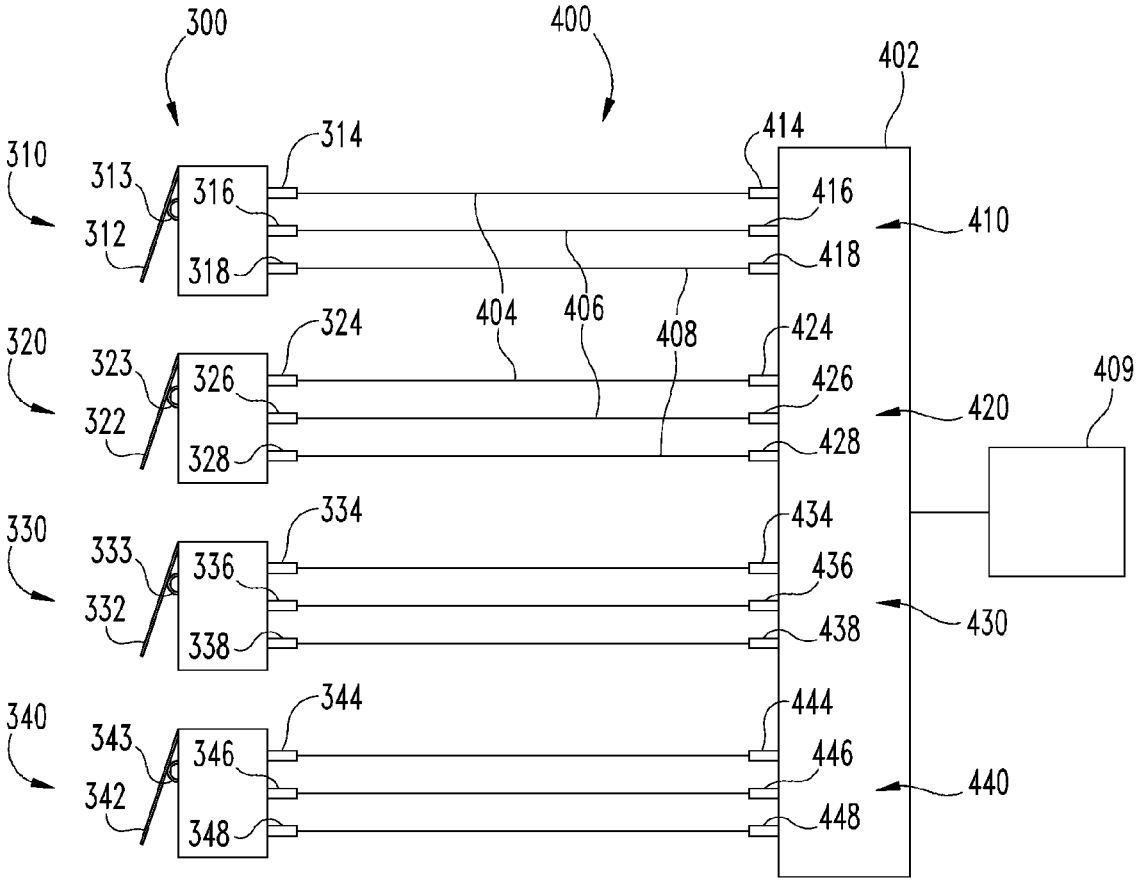
FIG. 9 is a schematic illustration of a control circuit according to one embodiment.

With reference to FIG. 9, a schematic block diagram of a control circuit 400 according to one embodiment is illustrated. The circuit 400 includes the sensor assembly 300 connected to a controller 402 via a plurality of signal lines 404 and a plurality of first and second return lines 406, 408. The controller 402 is further connected to a power source 409, and transmits electrical signals to the sensor assembly 300 through the signal lines 404. The controller 402 may be an on-board controller such as, for example, the controller 106, or may be remote from the lock assembly as with the control system 108, and may perform various functions additional functions such as those described above with reference to the controller 106, the user interface 107, and/or the control system 108.

As noted above, the illustrated sensor assembly 300 comprises a plurality of SPDT microswitches, each of which includes a leaf spring. As shown in FIG. 9, each of the microswitches also includes an actuator such as a button, and a number of terminals. For example, the top sensor 310 includes a button 313 actuated by the leaf spring 312, an input terminal 314, a normally open terminal 316, and a normally closed terminal 318. The schematic representations of the remaining sensors 320, 330, 340 are substantially similar to that of the top sensor 310, and similar reference characters are used to indicate similar elements and features.

The controller 402 includes a plurality of contact groups including a top sensor contact group 410, a bottom sensor contact group 420, a lock sensor contact group 430, and an auxiliary bolt sensor contact group 440. Each of the contact groups includes three contacts connected to the terminals of the corresponding sensor via one of the signal lines 404, one of the first return lines 406, and one of the second return lines 408. For example, the top sensor contact group 410 includes a signal contact 414 connected to the input terminal 314 via one of the signal lines 404, a first return contact 416 connected to the normally open terminal 316 via one of the first return lines 406, and a second return contact 418 connected to the normally closed terminal 318 via one of the second return lines 408. The remaining contact groups 420, 430, 440 are substantially similar to the top sensor contact group 410, and similar reference characters are used to indicate similar elements and features.

In operation, the controller 402 issues the first signal via the signal contact 414, the sensor 310 transmits the first signal through one of the output terminals 316, 318, and the controller 402 receives the first signal at one of the return contacts 416, 418. When the button 313 is actuated (i.e., when the leaf spring 312 is depressed), the input terminal 314 is electrically connected to the normally open terminal 316, the top sensor 310 transmits the first signal to the controller 402 through the first return line 406, and the controller 402 receives the first signal at the first return contact 416. When the button 313 is not actuated (i.e., when the leaf spring 312 is not depressed), the input terminal 314 is electrically connected to the normally closed terminal 318, the top sensor 310 transmits the first signal to the controller 402 through second return line 408, and the controller 402 receives the first signal at the second return contact 418.

Due to the fact that the controller 402 is connected to each of the terminals of each of the sensors, the controller 402 may continuously receive each of the signals through one of the return lines 406, 408 connected to the corresponding sensor. Thus, each of the sensors may operate as a dual-action switch which performs the functions of both a normally open switch and a normally closed switch. As such, the controller 402 may interpret various conditions of the lock assembly 100 based at least in part on whether the signal is being transmitted through one of the first return lines 406 (i.e., from the normally open terminal) or through one of the second return lines 408 (i.e., from the normally closed terminal).

For example, in the illustrated embodiment, when the top hub cam surface 218 is engaged with the top sensor leaf spring 312, the button 313 is depressed, and the top sensor 310 transmits the first signal through the normally open terminal 316. Thus, the controller 402 may interpret receiving the first signal at the top sensor first return contact 416 as indicating a home position of the top hub 210. When the cam surface 218 is not engaged with the leaf spring 312, the button 313 is not depressed, and the top sensor 310 transmits the first signal through the normally closed terminal 318. As such, the controller 402 may interpret receiving the first signal at the top sensor second return contact 418 as indicating a rotated position of the top hub 210. The controller 402 may additionally interpret the rotated position of the top hub 210 as a request to exit condition or a request to enter condition depending on whether the top hub 210 is connected to the inner handle or the outer handle.

Similarly, when the bottom hub cam surface 228 is engaged with the bottom sensor leaf spring 322, the button 323 is depressed, and the bottom sensor 320 transmits the second signal through the normally open terminal 326. Thus, the controller 402 may interpret receiving the second signal at the bottom sensor first return contact 426 as indicating a home position of the bottom hub 220. When the cam surface 228 is not engaged with the leaf spring 322, the button 323 is not depressed, and the bottom sensor 320 transmits the second signal through the normally closed terminal 328. As such, the controller 402 may interpret receiving the second signal at the bottom sensor second return contact 428 as indicating a rotated position of the bottom hub 220. The controller 402 may additionally interpret the rotated position of the bottom hub 220 as a request to exit condition or a request to enter condition depending on whether the bottom hub 220 is connected to the inner handle or the outer handle.

When the catch 120 is engaged with the lock sensor leaf spring 332, the button 333 is depressed and the lock sensor 330 transmits the third signal through the normally open terminal 336. Thus, the controller 402 may interpret receiving the third signal at the lock sensor first return contact 436 as indicating a locking position of the catch 120, which in turn indicates a locked condition of the lock assembly 100. When the catch 120 is not engaged with the leaf spring 332, the button 333 is not depressed, and the lock sensor 330 transmits the third signal through the normally closed terminal 338. As such, the controller 402 may interpret receiving the third signal at the lock sensor second return contact 438 as indicating an unlocking position of the catch 120, which in turn indicates an unlocked condition of the lock assembly 100.

When the auxiliary bolt 142 is engaged with the auxiliary bolt sensor leaf spring 342, the button 343 is depressed, and the auxiliary bolt sensor 340 transmits the fourth signal through the normally open terminal 346. Thus, the controller 402 may interpret receiving the fourth signal at the auxiliary bolt sensor first return contact 446 as indicating a retracted position of the auxiliary bolt 142, which may in turn indicate a door closed condition. When the auxiliary bolt 142 is not engaged with the leaf spring 342, the button 343 is not depressed, and the auxiliary bolt sensor 340 transmits the fourth signal through the normally closed terminal 348. As such, the controller 402 may interpret receiving the fourth signal at the auxiliary bolt sensor second return contact 448 as indicating an extended position of the auxiliary bolt 142, which may in turn indicate a door open condition.

As can be seen from the foregoing, the above-described sensor assembly 300 may enable detection of a plurality of conditions of the lock assembly 100 utilizing a compact form factor. Specifically, the sensor assembly 300 may detect a request to exit condition, a request to enter condition, and locked/unlocked condition with a single assembly including a plurality of sensors 310, 320, 330 mounted on a single PCB 302. Due to the compact nature of the sensor assembly 300, such features can easily be incorporated into current lock assembly designs, whether in a factory setting or as a retrofit to an existing assembly.

Figure 10:
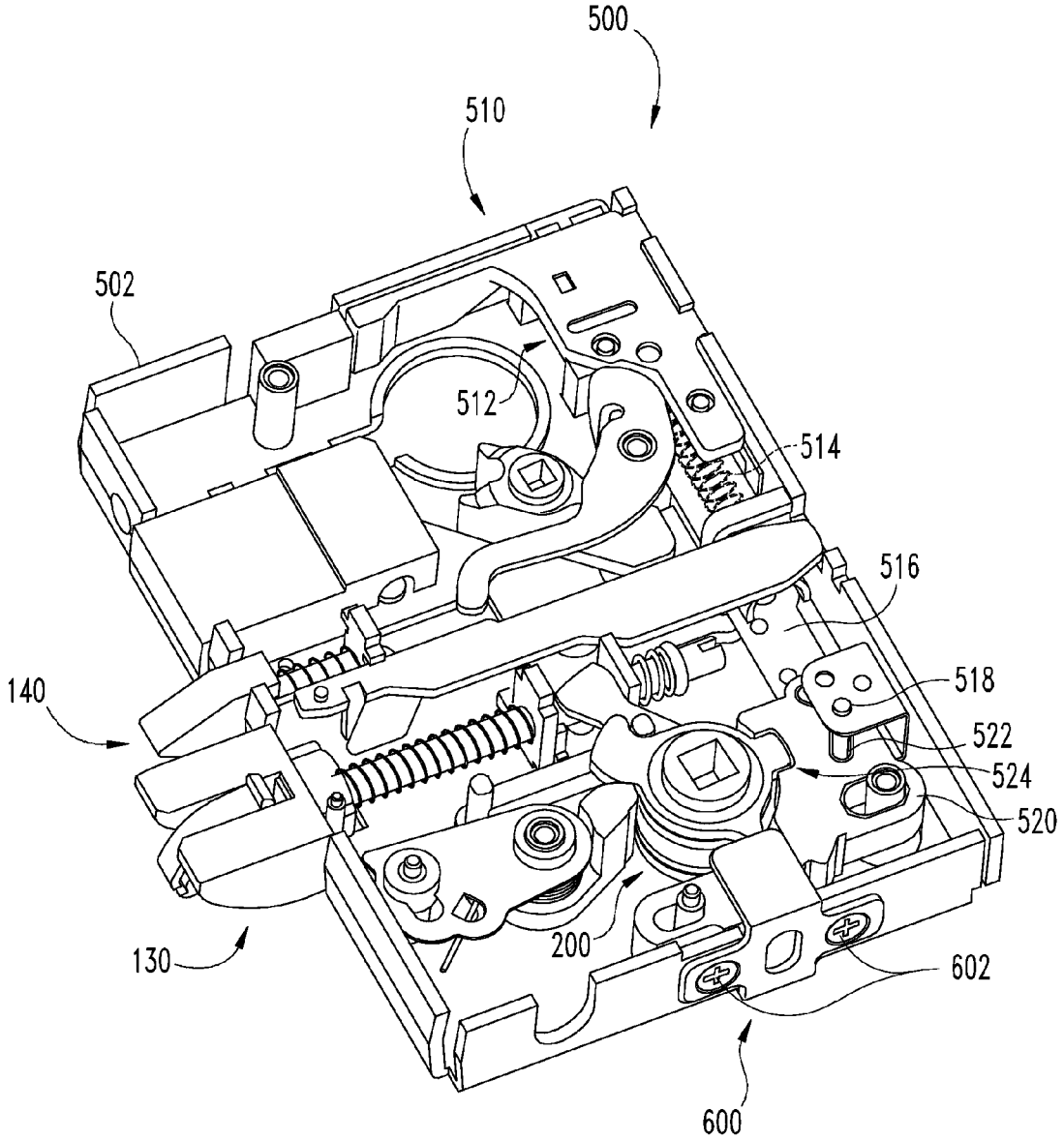
FIG. 10 is a perspective view of a lock assembly according to one embodiment.
Figure 12:
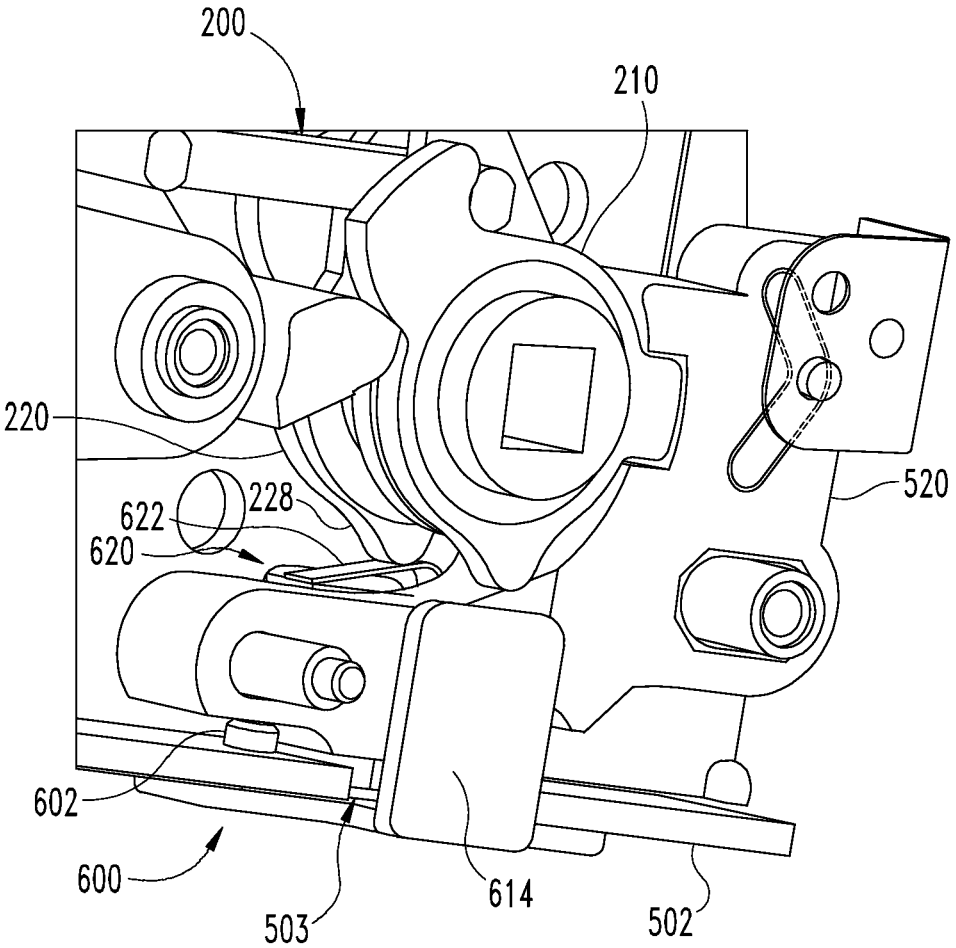
FIG. 12 depicts the sensor assembly of FIG. 11 mounted to the lock assembly of FIG. 10 in a first configuration.

With reference to FIG. 10, an illustrative mortise lock assembly 500 according to another embodiment includes a latch bolt assembly 130, a deadlocking assembly 140, and the transmission assembly 200 described above with reference to the mortise lock assembly 100, as well as a drive assembly 510, a locking member or catch 520, and a sensor assembly 600. The lock assembly 500 further includes a case 502 which houses various components of the lock assembly 500, and a cover plate (not illustrated) which encloses various elements of the lock assembly 500 within the case 502. As shown in FIG. 12, the case 502 includes an opening 503 operable to receive at least a portion of the sensor assembly 600.

The drive assembly 510 includes an electromechanical actuator in the form of a rotary motor 512 such as a stepping motor, and a helical spring 514 connected to an output shaft of the motor 512. The drive assembly 510 further includes a link 516 coupled to the spring 514 such that the link 516 moves longitudinally in response to rotation of the motor shaft. An exemplary form of this type of drive assembly is disclosed in the above-referenced U.S. patent application Ser. No. 14/194,605, and therefore need not be further described herein.

The catch 520 is similar to the previously-described catch 120, and similar reference characters are used to indicate similar elements and features. Like the previously-described catch 120, the catch 520 is coupled to the link 516 such that the catch 520 moves laterally between a locking position and an unlocking position in response to longitudinal movement of the link 516.

Figure 11:
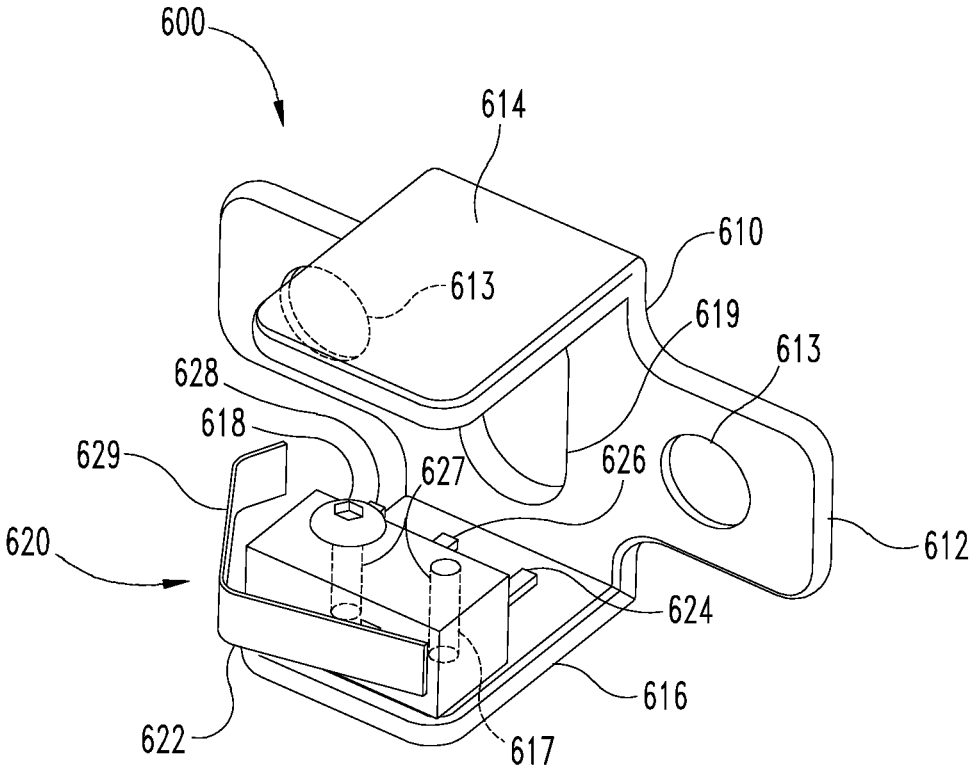
FIG. 11 is a perspective illustration of a sensor assembly according to one embodiment.

With reference to FIG. 11, the sensor assembly 600 includes a bracket 610 and a sensor 620 releasably mounted to the bracket 610. The bracket 610 includes a base plate 612, and a pair of arms 614, 616 extending in a direction substantially perpendicular to the base plate 612. The base plate 612 may further comprise an opening 619 through which wires may be passed to connect the sensor 620 to a control system. One of the arms 616 includes a mounting feature such as, for example, a post 617 which is used to secure the sensor 620 to the bracket 610. The illustrated base plate 612 includes laterally spaced mounting holes 613, and the case 502 may define corresponding mounting holes on opposite sides of the opening 503. Fasteners 602 such as, for example, screws may be passed through the mounting holes in the bracket 610 and the case 502 to releasably secure the bracket 610 to the case 502.

As should be appreciated, the fasteners 602 and the mounting holes 613 comprise a portion of a first coupling operable to selectively, releasably and reversibly couple the bracket 610 to the case 502. In other words, the bracket 610 is operable to be selectively mounted to the case 502 in each of a first orientation and a second orientation, wherein the first orientation is angularly offset from the second orientation by 180° about a lateral axis defined by the bracket 610. In the first orientation, one of the arms 614, 616 is positioned proximate to the back plate of the housing 502, and in the second orientation the other of the arms 614, 616 is positioned proximate to the back plate of the housing 502.

The exemplary sensor 620 is substantially similar to the above-described lock sensor 330, except that the illustrated sensor 620 is configured as a normally closed switch. In other words, the sensor 620 is connected to the controller through the normally closed output terminal 628. While the illustrated sensor 620 is an SPDT snap-action switch comprising a leaf spring 622 including an angled segment 629, it is also contemplated that the sensor 620 may be a simulated roller switch similar to the above-described sensors 310, 320. It is further contemplated that the sensor 620 may be configured as another form of an electric switch or sensor such as, for example, those described above. The sensor 620 further includes terminals 624, 626, 628 to which the wires may be attached to electrically couple the sensor 620 to the control system.

The sensor 620 further defines a pair of laterally spaced openings 627 extending therethrough. When the sensor 620 is mounted to the bracket 610, one of the openings 627 receives the post 617, and a fastener such as a screw 618 passes through the other opening 617 to releasably secure the sensor 620 to the bracket 610. As will be appreciated, the sensor 620 can be selectively mounted to the bracket 610 in a first position and a second position, wherein the first position is angularly offset from the second position by 180° about a lateral axis of the sensor 620. Thus, while FIG. 11 depicts the leaf spring 622 extending toward the left side of the bracket 610, this orientation can be reversed by removing the screw 618 and flipping the sensor 620 about its lateral axis such that the leaf spring 622 extends toward the right side of the bracket 610. In the reverse or second position, each of the post 617 and the screw 618 is located in the opening 627 previously occupied by the other of the post 617 and the screw 618. In other words, the post 617, the screw 618, and the openings 627 comprise a second coupling operable to selectively, releasably and reversibly couple the sensor 620 to the bracket 610.

In the illustrated form, the first coupling comprises fasteners 602 and the second coupling comprises a post 617 and a screw 618. However, it is also contemplated that other forms of releasable and/or reversible couplings may be utilized. By way of a non-limiting example, such couplings may include mating snap features, posts, threaded engagement, or the like. In one embodiment, the bracket 610 and the sensor 620 may include mating snap features such that the sensor 620 can be selectively mounted to the bracket 610 in either position. In other embodiments, each of the arms 614, 616 may include a post or another mounting feature such that the sensor 620 can be releasably and selectively secured to either of the arms 614, 616.

Due to the fact that sensor 620 can be coupled on the bracket 610 in either of two positions, and the bracket 610 can be coupled to the case 502 in either of two orientations, the sensor assembly 600 can be mounted to the lock assembly 500 in a plurality of configurations. In a first configuration, the sensor 620 may be selectively coupled to the bracket 610 in the first position, and the bracket 610 may be selectively coupled to the case 502 in the first orientation. In a second configuration, the sensor 620 may be selectively coupled to the bracket 610 in the second position, and the bracket 610 may be selectively coupled to the case 502 in the second orientation. It is also contemplated that two or more of the configurations may comprise the same position of the sensor 620 relative to the bracket 610, or the same orientation of the bracket 610 with respect to the case 502.

FIG. 12 depicts the sensor assembly 600 mounted to the case 502 in the first configuration, wherein the sensor 620 is associated with the bottom hub 220. In this configuration, the sensor 620 is passed through an opening 503 formed in the case 502, and is positioned between the catch 520 and the back plate of the case 502. When the bottom hub 220 is in the home position, the cam surface 228 engages the leaf spring 622, thereby retaining the leaf spring 622 in the depressed position. When the bottom hub 220 is rotated, the leaf spring 622 is released, thereby causing the sensor 620 to transition states. This operation is substantially similar to that described above with reference to the previously-described sensor assembly 300, and details regarding the illustrated and alternative forms of such operation need not be repeated.

Figure 13:
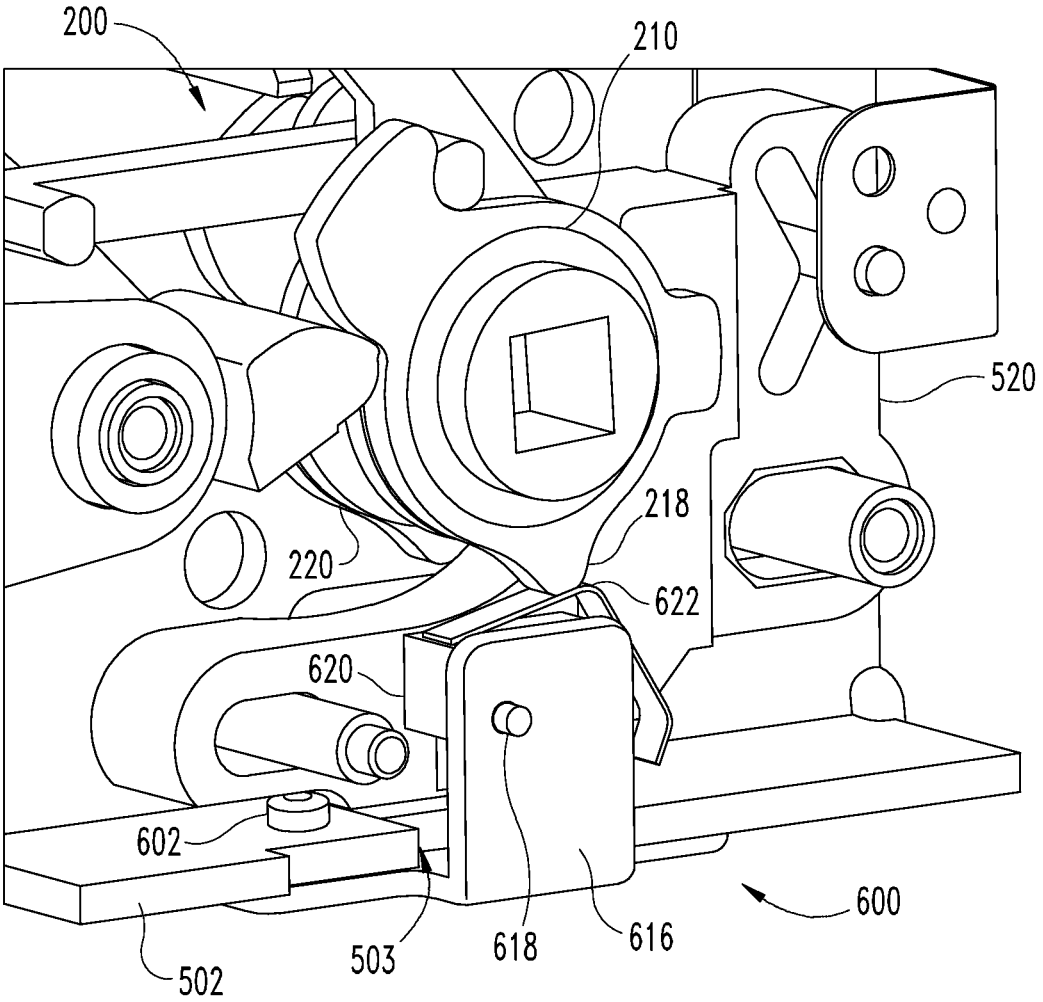
FIG. 13 depicts the sensor assembly of FIG. 11 mounted to the lock assembly of FIG. 10 in a second configuration.

As illustrated in FIG. 13, the sensor assembly 600 may also be selectively mounted to the case in a second orientation. In order to selectively change the mounting orientation from that illustrated in FIG. 12 to the mounting orientation illustrated in FIG. 13, the screws 602 are removed and the sensor assembly 600 is removed from the case 502. The screw 618 is then removed, and the sensor 620 is mounted to the bracket 610 in the second position, as described in detail above. The sensor assembly 600 is then positioned on the case 502 in a second orientation such that the sensor 620 passes through the opening 503 between the catch 520 and the cover plate (not illustrated). The bracket 610 is then fastened to the case 502 in the second orientation with the screws 602. With the sensor assembly 600 mounted in the second configuration, the sensor 620 is associated with the top hub 220. When the top hub 210 is in the home position, the normally closed switch 620 is retained in the open state, and when the top hub 210 is rotated, the sensor 620 transitions to the closed state and sends a signal as described above.

In the illustrated embodiment, the sensor assembly 600 comprises a single sensor 620 mounted to the bracket 610. It is also contemplated that the sensor assembly 600 may comprise a plurality of sensors mounted to the bracket 610. For example, each of the arms 614, 616 may include a post or another attachment feature, and a sensor may be mounted to each of the arms 614, 616, such that a sensor is associated with each of the hubs 210, 220.

Furthermore, while the sensor 620 has been described as a normally closed switch connected to the controller through the normally closed output terminal 628, it is also contemplated that the sensor 620 may be configured as a normally open switch such as, for example, in embodiments in which the cam surfaces 218, 228 comprise recesses in place of protrusions. It is further contemplated that the sensor 620 may be a dual-action switch connected to the controller through each of the output terminals 626, 628. In such embodiments, the sensor 620 may continuously transmit the signal to the controller through the output terminal corresponding to the position of the leaf spring 622 such as, for example, as described in detail above with reference to FIG. 9.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A sensor assembly operable to detect a condition of a locking assembly including a case which houses a first hub having a first home position and a first rotated position, a second hub having a second home position and a second rotated position, and a retraction assembly operable to retract a latch bolt in response to an actuating force causing rotation of either of the first and second hubs, and wherein the case comprises an opening aligned with the first and second hubs, the sensor assembly comprising:

a bracket configured for receipt within the opening;

a sensor operable to transmit a signal in response to an actuating input;

a first coupling operable to couple the sensor to the bracket; and a second coupling operable to couple the bracket to the case; and wherein the sensor assembly is structured for connection to the locking assembly in each of a first configuration and a second configuration;

wherein, in the first configuration, the sensor is associated with the first hub, and the actuating input comprises one of the first home position and the first rotated position; and wherein, in the second configuration, the sensor is associated with the second hub, and the actuating input comprises one of the second home position and the second rotated position.

2. The sensor assembly of claim 1, wherein the bracket includes a base plate and an arm extending from the base plate; and wherein the first coupling couples the sensor to the arm.

3. The sensor assembly of claim 1, wherein the first coupling comprises a first releasable coupling structured to releasably couple the sensor to the bracket in each of a first position and a second position; and wherein the second coupling comprises a second releasable coupling structured to releasably couple the bracket to the case in each of a first orientation and a second orientation; and wherein, in the first configuration, the sensor is coupled to the bracket in the first position, and the bracket is coupled to the case in the first orientation; and wherein, in the second configuration, the sensor is coupled to the bracket in the second position, and the bracket is coupled to the case in the second orientation.

4. The sensor assembly of claim 3, wherein the sensor comprises a microswitch including a leaf spring; and wherein, in the first configuration, the leaf spring is engaged with a first cam surface when the first hub is in the first home position and is disengaged from the first cam surface when the first hub is in the first rotated position, and the actuating input comprises one of engagement with the first cam surface and disengagement from the first cam surface; and wherein, in the second configuration, the leaf spring is engaged with a second cam surface when the second hub is in the second home position and is disengaged from the second cam surface when the second hub is in the second rotated position, and the actuating input comprises one of engagement with the second cam surface and disengagement from the second cam surface.

5. The sensor assembly of claim 4, wherein the first position is angularly offset from the second position by 180° about a lateral axis of the microswitch; and wherein the first orientation is angularly offset from the second orientation by 180° about a lateral axis of the bracket.

6. The sensor assembly of claim 1, wherein the sensor comprises a snap-action switch including a first output terminal and a second output terminal; and wherein the snap-action switch is configured to transmit the signal through the first output terminal in response to the actuating input, and is further configured to transmit the signal through the second output terminal in response to a secondary actuating input;

wherein, in the first configuration, the secondary actuating input comprises the other of the first home position and the first rotated position; and wherein, in the second configuration, the secondary actuating input comprises the other of the second home position and the second rotated position.

7. The sensor assembly of claim 6, wherein the snap-action switch further comprises a resilient trigger arm having a first position and a second position;

wherein the first hub comprises a first cam surface; wherein the second hub comprises a second cam surface;

wherein, in the first configuration:

with the first hub in the first home position, the first cam surface is engaged with the trigger arm;

with the first hub in the first rotated position, the first cam surface is disengaged from the trigger arm;

the trigger arm comprises the first trigger arm position in response to engagement with the first cam surface;

the trigger arm comprises the second trigger arm position in response to disengagement from the first cam surface;

the actuating input further comprises the first trigger arm position; and the secondary actuating input further comprises the second trigger arm position; and wherein, in the second configuration:

with the second hub in the second home position, the second cam surface is engaged with the trigger arm;

with the second hub in the second rotated position, the second cam surface is disengaged from the trigger arm;

the trigger arm comprises the first trigger arm position in response to engagement with the second cam surface;

the trigger arm comprises the second trigger arm position in response to disengagement from the second cam surface;

the actuating input further comprises the first trigger arm position; and the secondary actuating input further comprises the second trigger arm position.

8. A system, comprising:

a locking assembly including:

a case defining an opening;

first and second hubs rotatably mounted in the case and aligned with the opening, wherein each of the hubs is independently rotatable and is configured to rotate in response to an external actuating force applied thereto;

a latch assembly biased to a locking position and having an unlocking position in response to rotation of either of the first and second hubs; and a locking element operable to selectively prevent rotation of the first hub; and a sensor assembly including a sensor operable to transmit a signal and structured to be received in the opening in a first configuration and a second configuration; and wherein, in the first configuration, the sensor is associated with the first hub and transmits the signal in response to rotation of the first hub; and wherein, in the second configuration, the sensor is associated with the second hub and transmits the signal in response to rotation of the second hub.

9. The system of claim 8, wherein the sensor assembly further comprises a bracket, and wherein the sensor is releasably engaged to the bracket.

10. The system of claim 9, wherein the bracket is operable to be selectively coupled to the case in a first bracket position and a second bracket position; and wherein the sensor is structured for coupling to the bracket in a first sensor position and a second sensor position;

wherein the first configuration comprises the first bracket position and the first sensor position; and wherein the second configuration comprises the second bracket position and the second sensor position.

11. The system of claim 10, wherein the sensor comprises an electrical switch including a normally open terminal and a normally closed terminal, and wherein the electrical switch transmits the signal via one of the normally open terminal and the normally closed terminal in response to rotation of the hub with which the sensor is associated.

12. The system of claim 10, wherein the first hub comprises a first cam surface, and the second hub comprises a second cam surface;

wherein the sensor comprises a snap-action switch including a first output terminal, a second output terminal, and a leaf spring having a first leaf spring position and a second leaf spring position;

wherein in the first configuration, when the first hub is not rotated, the leaf spring engages the first cam surface and is in the first leaf spring position, and when the first hub is rotated, the leaf spring does not engage the first cam surface and is in the second leaf spring position;

wherein in the second configuration, when the second hub is not rotated, the leaf spring engages the second cam surface and in in the first leaf spring position, and when the first hub is rotated, the leaf spring does not engage the second cam surface and is in the second leaf spring position; and wherein the snap-action switch is configured to transmit the signal via the first terminal in response to the first leaf spring position, and to transmit the signal via the second terminal in response to the second leaf spring position.

13. The system of claim 8, wherein the locking element is movably mounted to the case in a first position, and is adjustable to a second position in which the locking element is operable to selectively prevent rotation of the second hub.

14. The system of claim 8, wherein the sensor assembly further comprises a bracket on which the sensor is mounted, wherein the first configuration of the sensor assembly includes a first orientation of the bracket relative to the case and a first position of the sensor relative to the bracket, and wherein the second configuration of the sensor assembly includes at least one of a second orientation of the bracket relative to the case or a second position of the sensor relative to the bracket.

15. A mortise lockset, comprising:

a case including an opening;

a first hub rotatably mounted in the case, wherein the first hub is configured to rotate in response to actuation of a first handle;

a second hub rotatably mounted in the case, wherein the second hub is configured to rotate in response to actuation of a second handle, and wherein the first hub and the second hub are independently rotatable;

a latchbolt movably mounted to the case, the latchbolt having an extended position and a retracted position;

a retraction assembly engaged with the latchbolt, the first hub, and the second hub, wherein the retraction assembly is configured to retract the latchbolt in response to rotation of the first hub by the first handle, and wherein the retraction assembly is configured to retract the latchbolt in response to rotation of the second hub by the second handle; and a sensor assembly comprising a bracket mounted to the case and a sensor mounted to the bracket, wherein the sensor assembly extends into the case via the opening, and wherein the sensor is operable to selectively transmit a signal indicative of an attempt to retract the latchbolt;

wherein the sensor assembly is selectively mountable to the case in each of a first configuration and a second configuration;

wherein with the sensor assembly mounted to the case in the first configuration, the sensor is configured to transmit the signal in response to rotation of the first hub by the first handle; and wherein with the sensor assembly mounted to the case in the second configuration, the sensor is configured to transmit the signal in response to rotation of the second hub by the second handle.

16. The mortise lockset of claim 15, further comprising a catch movably mounted in the case and aligned with one of the first hub and the second hub, wherein the catch is operable to selectively prevent rotation of the hub with which the catch is aligned.

17. The mortise lockset of claim 16, wherein the catch is mountable to the case at each of a first position in which the catch is aligned with the first hub, and a second position in which the catch is aligned with the second hub.

18. The mortise lockset of claim 17, wherein with the catch mounted to the case at the first position, the sensor assembly is mounted to the case in the second configuration; and wherein with the catch mounted to the case at the second position, the sensor assembly is mounted to the case in the first configuration.

19. The mortise lockset of claim 16, wherein the bracket includes a first arm and an opposite second arm, wherein the sensor is mounted to the first arm such that a gap is formed between the sensor and the second arm, and wherein a portion of the catch is received in the gap.

20. The mortise lockset of claim 16, wherein the first configuration comprises a first orientation of the bracket relative to the case, and wherein the second configuration comprises a reversed second orientation of the bracket relative to the case.

21. The mortise lockset of claim 16, wherein the first configuration comprises a first position of the sensor relative to the bracket, and wherein the second configuration comprises a reversed second position of the sensor relative to the bracket.

* * * * *